US006609545B1

(12) United States Patent
Gelder

(10) Patent No.: US 6,609,545 B1
(45) Date of Patent: Aug. 26, 2003

(54) WOOD CUTTING HEAD STRUCTURE

(76) Inventor: Ian Van Gelder, P.O. Box 1123, Carson City, CA (US) 89702

( * ) Notice: Subject to any disclaimer, the term of this patent is extended or adjusted under 35 U.S.C. 154(b) by 0 days.

(21) Appl. No.: 09/882,584

(22) Filed: Jun. 15, 2001

(51) Int. Cl.[7] ..... B27L 7/00

(52) U.S. Cl. ..... 144/195.8; 144/193.1; 144/184

(58) Field of Search ..... 144/193.1, 193.2, 144/195.1, 195.8, 366, 190, 184; 254/104

(56) References Cited

U.S. PATENT DOCUMENTS

| | | | | |
|---|---|---|---|---|
| 4,157,105 A | | 6/1979 | Gansley | |
| 4,293,013 A | | 10/1981 | Phelps et al. | |
| 4,337,809 A | * | 7/1982 | Bertolette et al. | 144/195.1 |
| 4,353,401 A | * | 10/1982 | Schilling | 144/195.1 |
| 4,434,825 A | * | 3/1984 | Blomqvist et al. | 144/195.8 |
| 4,483,379 A | | 11/1984 | Aikins et al. | |
| 4,537,235 A | * | 8/1985 | Aderneck | 144/195.7 |
| 4,641,694 A | | 2/1987 | Rohde | |
| 4,782,866 A | * | 11/1988 | Valdez | 144/195.8 |
| 4,800,937 A | * | 1/1989 | Mangus, Sr. | 144/195.8 |
| 4,860,806 A | | 8/1989 | Brace | |
| 5,086,820 A | | 2/1992 | Gelder | |

FOREIGN PATENT DOCUMENTS

| | | | | |
|---|---|---|---|---|
| SU | 000547345 | * | 2/1977 | 144/195.9 |

* cited by examiner

*Primary Examiner*—W. Donald Bray
(74) *Attorney, Agent, or Firm*—Theodore J. Bielen, Jr.

(57) ABSTRACT

A cutting head structure for a wood splitter utilizing a frame member. The frame member includes a bottom, a pair of sides, and a top to form an open chamber. The open chamber has a first opening for receiving a wood mass and a second opening to receive the divided or split portions of the wood mass. At least one knife is located in the open chamber and includes a blade having a single, continuous, curved cutting edge which faces the opening through which the wood mass is fed.

10 Claims, 2 Drawing Sheets

WOOD CUTTING HEAD STRUCTURE

BACKGROUND OF THE INVENTION

The present invention relates to a novel and useful cutting head structure for a wood splitter.

Log splitters have been proposed to divide or split logs by pushing the log through cutting knives by the use of hydraulic cylinders. The size of the splitting knives and the hydraulic cylinders is dependent on the size of the logs, the moisture content of the logs, the type of wood contained in the logs, and the like. Certain types of wood are prone to contain knots which can serve as a source of damage to the knives of a log or wood splitter. That is to say, knots possess a different composition than the surrounding wood material and are denser and lack cleavage planes that are contiguous with the surrounding wood material.

Prior log splitters have included multiple knives of varying shapes. For example, U.S. Pat. Nos. 4,157,105 and 4,293,013 describe splitting elements having multiple faces exposed in diverging relationship to one another to form a wedge.

U.S. Pat. Nos. 4,483,379 and 4,641,694 describe splitting devices for wood which use a knife having an angulated edge.

U.S. Pat. No. 5,086,820 shows a wood splitting apparatus in which a chamber is formed holding a splitting head. The splitting head includes wedge-shaped knives in alternating rows.

U.S. Pat. No. 4,782,866 describes a lock splitting head having a plurality of knives within a chamber that are angulated relative to a central cutting blade or knife.

U.S. Pat. No. 4,860,806 shows a wood splitting head assembly having a plurality of blades which are positioned at various heights on a head and have a forward tilt. The blades include serpentine cutting edges to reduce resistance when the blade enters the wood being pushed through the wood splitter.

A cutting head structure for a wood splitter which is durable and efficient would be a notable advance in the field of forestry products.

BRIEF SUMMARY OF THE INVENTION

In accordance with the present invention a novel and useful cutting head structure for a wood splitter is herein provided.

The cutting head structure of the present invention utilizes a frame member. The frame member includes a bottom, two extending spaced side portions, and a top portion connected to the two optional spaced side portions. Consequently, the frame member possesses an open chamber having a first opening and a larger second opening opposite the first opening. The frame is a mounted on a support and is used in conjunction with a hydraulic ram or other mechanism for adapting the cutting head structure of the present invention for use as a log splitter.

At least one knife is located within the open chamber and supported by the frame member of that position. The knife includes a blade oriented to extend along one side of the chamber. The blade also extends from the top portion to the bottom portion within the chamber of the frame. The cutting edge of the blade is formed as a single continuous curved surface. The curved surface is oriented to extend concave inwardly relative to the chamber of the frame. In many cases, multiple knives are supported within the chamber of the frame in staggered configuration.

In addition, the frame member may be formed with a cutting edge which lies essentially perpendicular to the plane of the knife or knives within the chamber of the frame. The cutting edge combined with the knives are able to split logs of large proportions cleanly and efficiently without damage to the knives or the cutting edge.

It may be apparent that a novel and useful cutting head structure for a wood splitter has been hereinabove described.

It is therefore an object of the present invention to provide a cutting head structure for a wood splitter which is capable of splitting logs having knots within the log structure without damage to the cutting knives.

Another object of the present invention is to provide a cutting head structure for a wood splitter which is capable of splitting logs of relatively large size by using multiple passes through the wood splitter.

A further object of the present invention is to provide a cutting head structure for a wood splitter which may be easily manufactured and maintained during use.

Yet another object of the present invention is to provide a cutting head structure for a wood splitter which is compatible with hydraulic systems used to force logs through a wood splitter.

The invention possesses other objects and advantages especially as concerns particular characteristics and features thereof which will become apparent as the specification continues.

For a better understanding of the invention reference is made to the following detailed description of the preferred embodiments thereof which should be taken in conjunction with the hereinabove described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 1:
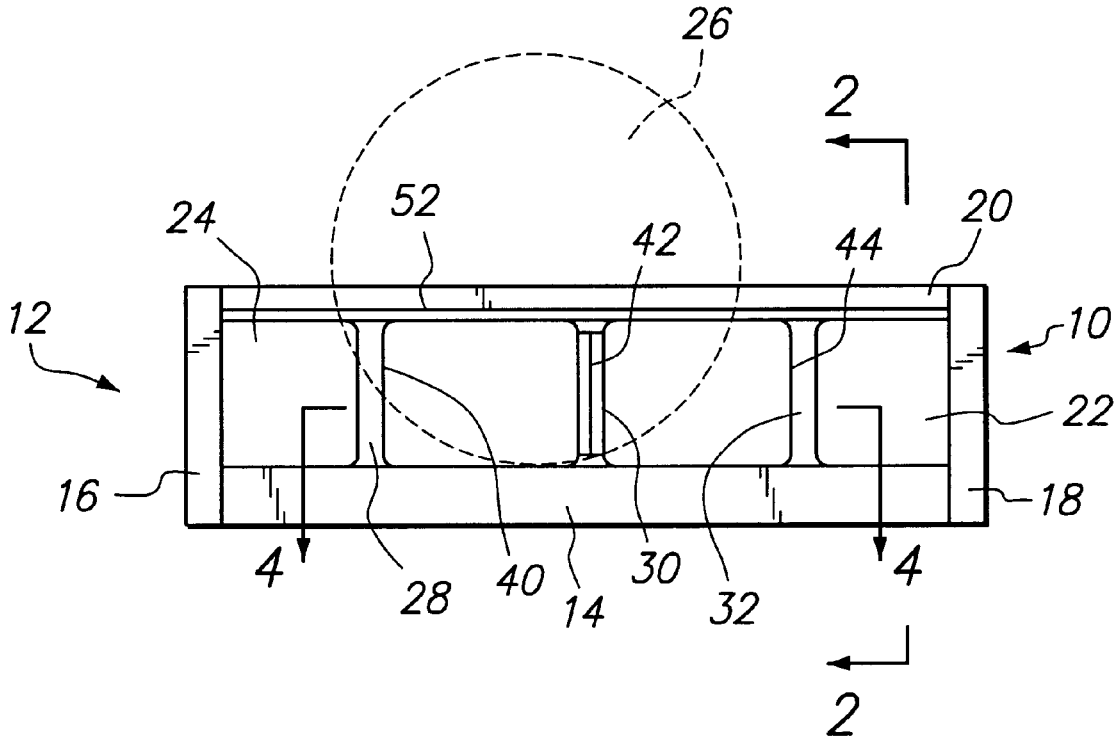
FIG. 1 is a front elevational view of the cutting head structure of the present invention.
Figure 4:
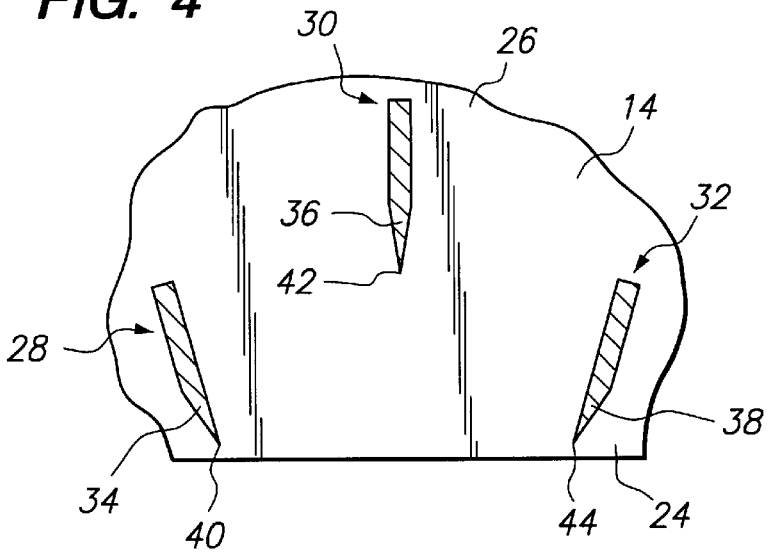
FIG. 4 is a sectional view taken along line 4—4 of FIG. 1.

The invention as a whole is depicted in the drawings by reference character 10. The cutting head structure 10 is intended to be mounted on a chasis or surface, such as a trailer, and is used in conjunction with an hydraulically operated ram (not shown). Splitting or cutting head 10 includes, as one of its elements, a frame member 12. Frame 12 is formed with a bottom portion 14 connected to two optional spaced side portions 16 and 18. Top portion 20 is supported by side portions 16 and 18 such that a chamber 22 is formed within frame 12. Chamber 22 may be formed by bottom portion 14, top portion 20, and cutting knives, which will be described hereinafter. Chamber 22 includes a first opening 24 and a second opening 25 which is larger than first opening 24. Generally, logs being split, such as log 26, depicted in phantom on FIG. 1, pass through chamber 22 from first opening 24 and out through second opening 25. Bottom portion 14, sides 16 and 18, and top portion 20 of frame 12 may be fastened together by bolts, screws, welding, gluing, and the like. Knives 28, 30, and 32 are supported within chamber 22 and oriented to span bottom 14 and top 20 along sides 16 and 18. With reference to FIG. 4, it may be observed that knives 28, 30, and 32 are staggered such that knives 28 and 30 lie near entrance 24 of chamber 22 while knife 30 is positioned further toward entrance 25 of chamber 22. Knives 28, 30, and 32 include blades 34, 36, and 38, respectively. In addition, cutting edges 40, 42, and 44 are associated with knives 28, 30, and 32, respectively.

Figure 2:
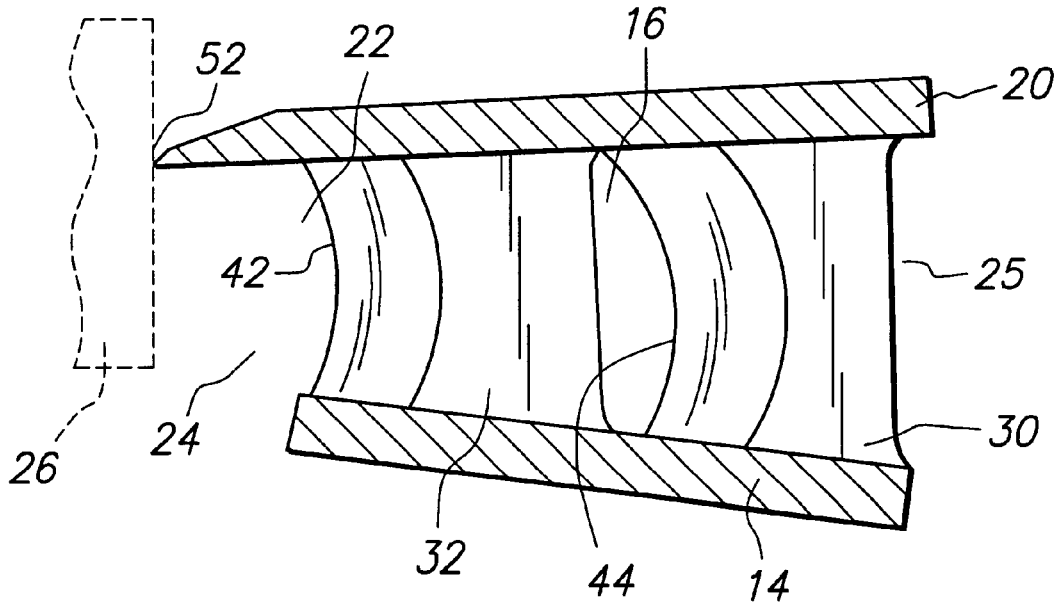
FIG. 2 is a sectional view taken along line 2—2 of FIG. 1.
Figure 3:
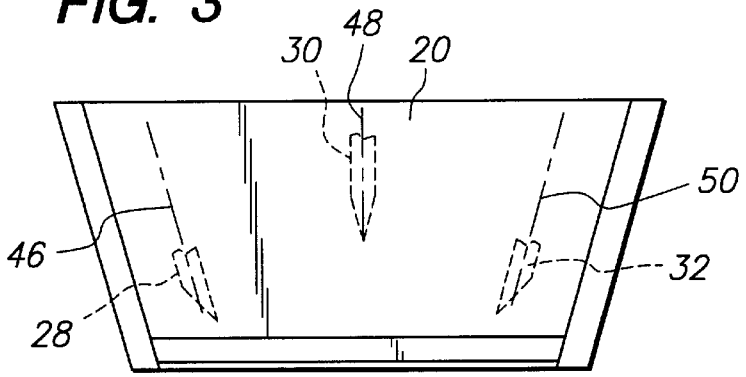
FIG. 3 is a top plan view of the cutting head structure of the present invention.

Turning again to FIG. 2, it may be apparent that cutting edges 42 and 44 are in the form of a single, continuous, inwardly curved configuration. Cutting edge 40 of knife 28 possesses the identical configuration (not shown in FIG. 2). FIGS. 3 and 4 depict the angular orientation of knives 28 and 32 relative to knife 30. Axial lines 46, 48, and 50 of FIG. 3 represent the alignment of knives 28, 30, and 32, respectively.

Returning again to FIGS. 1 and 2, it may be observed that top 20 terminates in a cutting edge 52 as shown. Cutting edge 52 produces a horizontal cut on log 26 while blades 28, 30, in and 32 produce a vertical cut on the same log.

Figure 5:
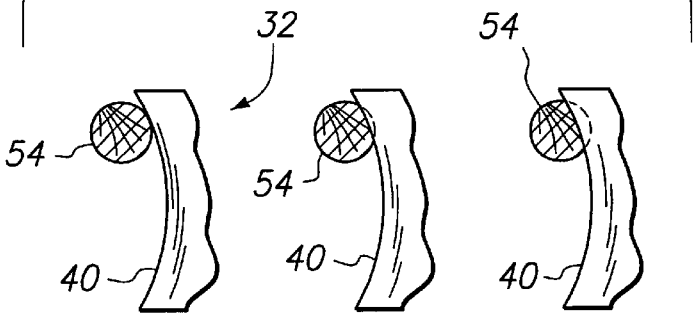
FIG. 5 is a schematic view showing the sequential cutting of a knot in a wooden log.

In operation, the user places log 26 against cutting head structure 10. An hydraulically operated ram pushes log 26 through frame 10 such that cutting edge 52 produces a horizontal split or a cut while blades 28, 30, and 32 produce a vertical cut. With reference to FIG. 5, it may be seen that a typical knot within log 26 is shown, schematically, as being sequentially cut by cutting edge 40 of knife 32. As may be seen, the cut on knot 54 progresses circumferentially around knot 54 at a lesser initial rate than a typical blade of orthogonal configuration. It has been found that knot 54 does not damage blade 32 because of the curved configuration of cutting edge 40. The same process occurs with cutting edges 42 and 44 of knives 30 and 32. Log 26 progresses from entrance 24 of chamber 22 and out through exit 26 of chamber 22 which is larger in size than entrance opening 24. Such "draft" may be observed in FIGS. 2 and 3 as extending horizontally and vertically.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A cutting head structure for a splitting wood, comprising:

a. a frame member, said frame member including a bottom, a top portion, said bottom, and a top portion forming an open chamber having a first opening and a second opening therethrough; and b. at least one knife at least partially located in said open chamber and supported thereat, said one knife including a blade oriented to extend along said chamber, said blade further including a cutting edge having single continuous curved configuration, said cutting edge of said one knife further being concave inwardly and being oriented to contact wood passing through said open chamber from said first opening to said second opening thereof.

2. The structure of claim 1 in which said frame member first opening to said open chamber is larger than said second opening to said open chamber.

3. The structure of claim 1 in which said one knife lies completely within said open chamber.

4. The structure of claim 1 in which said at least one knife comprises a plurality of knives, each of said plurality of knives including a blade, each oriented to extend along said chamber, each of said blades further including a cutting edge having a curved, inward, concave configuration each of said cutting edges of each of said blades being oriented to contact wood passing through said open chamber from said first opening to said second opening, thereof.

5. The structure of claim 1 in which a portion of said one knife extends between said bottom and said top of said open chamber.

6. The structure of claim 1 in which said top portion includes a blade formed adjacent said first opening, said blade having a cutting edge extending outwardly from said at least one knife, said blade essentially extending transversely relative to said first opening.

7. The structure of claim 6 in which said frame member first opening is larger than said second opening.

8. The structure of claim 6 in which said one knife lies completely within said open chamber.

9. The structure of claim 6 in which said at least one knife comprises a plurality of knives, each of said plurality of knives including a blade, each oriented to extend along said chamber, each of said blades further including a cutting edge having a curved, inward, concave configuration each of said cutting edges of each of said blades being oriented to contact wood passing through said open chamber from said first opening to said second opening, thereof.

10. The structure of claim 6 in which a portion of said one knife extends between said bottom and said top of said open chamber.

* * * * *